US005497224A

United States Patent [19]

Ishikawa et al.

[11] Patent Number: 5,497,224

[45] Date of Patent: Mar. 5, 1996

[54] IMAGE FORMING APPARATUS

[75] Inventors: Masaaki Ishikawa; Seiji Arai; Michihisa Iguchi, all of Tokyo, Japan

[73] Assignee: Kabushiki Kaisha Toshiba, Kanagawa, Japan

[21] Appl. No.: 205,229

[22] Filed: Mar. 3, 1994

[30] Foreign Application Priority Data

Mar. 4, 1993 [JP] Japan ..... 5-043627

[51] Int. Cl.[6] ..... G03G 21/00

[52] U.S. Cl. ..... 355/301; 355/296

[58] Field of Search ..... 355/269, 270, 355/301, 296, 298, 219, 245

[56] References Cited

U.S. PATENT DOCUMENTS

| | | | |
|---|---|---|---|
| 4,769,676 | 9/1988 | Mukai et al. . | |
| 5,055,882 | 10/1991 | Fushimi | 355/269 |
| 5,066,982 | 11/1991 | Hosoya et al. | 355/269 |
| 5,119,138 | 6/1992 | Oda et al. | 355/269 |
| 5,146,285 | 9/1992 | Kikuchi et al. | 355/270 |
| 5,148,219 | 9/1992 | Kohyama | 355/269 X |
| 5,187,525 | 2/1993 | Fushimi et al. | 355/269 |
| 5,196,892 | 3/1993 | Mitsuaki | 355/269 |
| 5,283,618 | 2/1994 | Hosoya et al. | 355/269 |
| 5,294,961 | 3/1994 | Ohtaka et al. | 355/270 X |
| 5,294,964 | 3/1994 | Oshiumi | 355/270 |
| 5,317,370 | 5/1994 | Kohyama et al. | 355/245 |

*Primary Examiner*—R. L. Moses

*Attorney, Agent, or Firm*—Finnegan, Henderson, Farabow, Garrett & Dunner

[57] ABSTRACT

An image forming apparatus includes a distributing device for distributing residual toner remaining on a photosensitive member after a developed toner image is transferred to a sheet-like paper and before a subsequent image is formed. The distributing device includes a distributing brush which is located between a transferring device and a charging device, has a contact portion contacting the photosensitive member, and includes a voltage supply device for supplying a direct current voltage to the distributing brush. The voltage difference between the distributing brush and the photosensitive member is sufficient to cause a discharge to occur between the distributing brush and photosensitive member.

16 Claims, 8 Drawing Sheets

IMAGE FORMING APPARATUS

BACKGROUND OF THE INVENTION

1. Field of the Invention

The present invention generally relates to an image forming apparatus, such as a facsimile and a copying apparatus, and more particularly to an image forming apparatus which has a developing section which causes a non-magnetic, single-component toner to attach to the electrostatic latent image formed on a photosensitive drum contacting the developing section.

2. Discussion of the Related Art

FIG. 9 shows a conventional image forming apparatus. The apparatus forms an image on a sheet of paper P by devices such as a charging device 100, an exposure device 102, a developing device 104, and a transfer device 106 provided around a photosensitive drum 108 rotating in a direction S. The charging device 100 charges the photosensitive drum 108. The exposure device 102 exposes the charged photosensitive member to form a latent image on the photosensitive drum 108. The developing device 104 develops the latent image with toner to form a developed toner image on the photosensitive drum 108. The transfer device 106 transfers the developed toner image on the photosensitive drum 108 to the sheet of paper P. In this state, some residual toner remains on the photosensitive drum 108. This residual toner blocks the light from the exposure device 102. In order to overcome this deficiency, the apparatus further includes a discharge device 110 and a distribution roller 112 rotating in a direction U, both of which are located between the transfer device 106 and the charging device 100.

The discharge device 110 includes a discharge charger 114. The discharge charger 114 is coupled to a condenser 116, which, in turn, is coupled to an alternating-current power source 118. Then, the discharge charger 114 discharges onto the photosensitive drum 108 so that the positive and negative coronas are balanced. Simultaneously, a mirror 122 reflects light from a discharge lamp 120 onto the photosensitive drum 108. As a result, the charge on the photosensitive drum 108 and the charge of the residual toner are zero. Therefore, the residual toner is not bound to the photosensitive drum 108. In this state, the residual toner remaining on the photosensitive drum 108 arrives at the distribution roller 112, which is coupled to a positive direct-current power source 124. The residual toner comes into sliding contact with the distribution roller 112, which strews the residual toner across the surface of the photosensitive drum 108. By strewing the residual toner across the surface of the photosensitive drum 108, the distribution roller 112 removes accumulations of residual toner having a thickness which would prevent the light from exposure device 102 from reaching the underlying surface of the photosensitive drum 108. Therefore, the light from the exposure device 102 may reach the entire surface area of the photosensitive drum 108 notwithstanding the presence of the strewn residual toner.

However, because the conventional apparatus requires two separate structural elements (e.g., the discharge device 110 having the charging device 114 coupled to the alternating-current power source 118, and the distributing roller 112 coupled to the direct-current power source 124), in order to strew the residual toner on the photosensitive drum 108, the apparatus becomes bulky and heavy.

SUMMARY OF THE INVENTION

Accordingly, the present invention has been made in view of the above circumstances and has an object to provide a smaller and more compact image forming apparatus having a decreased number of components for strewing residual toner on a photosensitive drum, compared to the conventional apparatus.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as appended drawings.

To achieve these and other objects and advantages and in accordance with the purposes of the invention, there is provided an image forming apparatus comprising, a photosensitive member, charging means for charging the photosensitive member, exposing means for exposing the photosensitive member to form a latent image on the photosensitive member, developing means for developing a latent image with toner to form a developed toner image on the photosensitive member, transferring means for transferring the developed toner image to a sheet-like material, distributing means for distributing residual toner remaining on the photosensitive member after the transfer of the developed toner image and before a subsequent image is to be formed, the distributing means including, a distributing brush located between the transferring means and the charging means, having a contact portion contacting the photosensitive member, and voltage supply means for supplying a direct current voltage to the distributing brush, the voltage difference between the distributing brush and the photosensitive member being sufficient to cause a discharge to occur between the distributing brush and the photosensitive member, and removing means for removing the distributed residual toner on the photosensitive member by transferring the distributed residual toner from the photosensitive member to the developing means, the removing means being operated simultaneously with the developing means.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate several embodiments of the invention and, together with the description, serve to explain the objects, advantages, and principles of the invention. In the drawings.

DESCRIPTION OF THE PREFERRED EMBODIMENTS

Reference will now be made in detail to the present preferred embodiments of the invention, examples of which are illustrated in the accompanying drawings.

Figure 1:
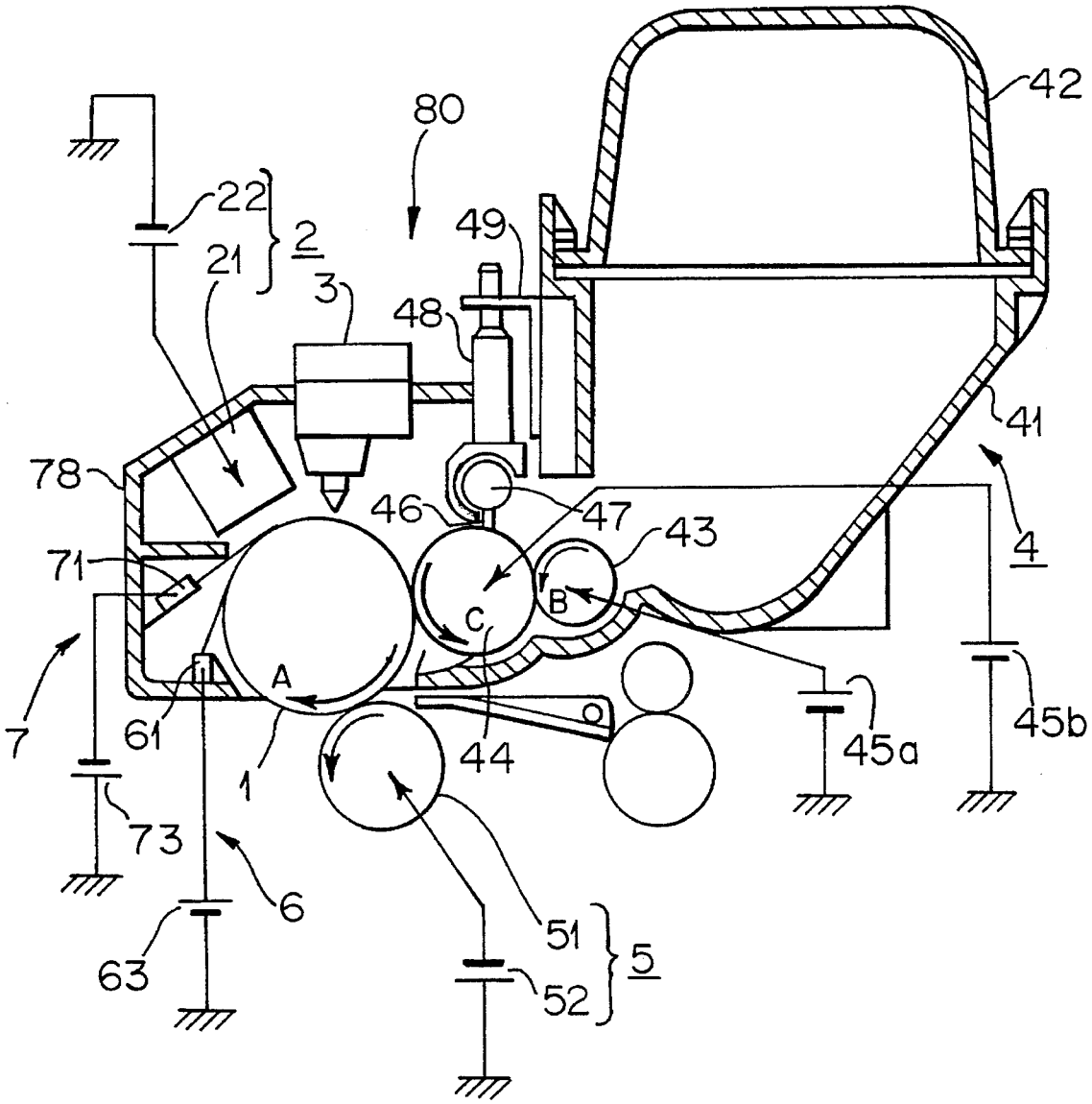
FIG. 1 is a schematic view illustrating a first embodiment of the present invention.

FIG. 1 shows the structure of the image forming apparatus constructed according to a first embodiment. The image forming apparatus includes a photosensitive member 1, a charging device 2, an exposure device 3, a developing device 4, a transfer device 5, a paper powder removal device 6 and a distributing device 7 arranged around the outer surface of a photosensitive drum 1. Of these components, the photosensitive drum 1, the charging device 2, and the developing device 4 are integrally supported by side covers 78 to form a process unit 80. The photosensitive drum 1 is positively charged and includes a photosensitive layer having an organic photoconductor, preferably including perylene pigment, phthalocyanine pigment, hydrazone derivative and polycarbonate. A rotary drive mechanism (not shown) rotates the photosensitive drum 1 in a clockwise direction A. The charging device 2 includes a charger 21 and a charging power source 22 which supplies a predetermined positive high voltage to the charger 21. The charging device 2 charges the surface of the photosensitive drum 1 to the predetermined voltage (e.g., +600 V).

The exposure device 3 preferably includes an LED array (not shown) which can be controlled in response to an image data of an image to be recorded.

The developing device 4 comprises a toner hopper 41, a toner pack 42, a feed roller 43, a developing roller 44, a feed roller power source **45*a*, a developing roller power source 45*b*, a developing blade 46, a support rod 47, a spring 48, and a support 49**.

The toner hopper 41 is a hollow container whose upper surfaces are partially open, for storing toner (not shown) therein. The toner pack 42 is mounted on the upper open portion of the toner hopper 41. The toner pack 42 is filled with toner, and its opening is sealed with a seal sheet (not shown). When the seal sheet is removed and the toner pack 42 is mounted on the toner hopper 41, the toner empties into the toner hopper 41.

The feed roller 43 is arranged at an opening on the side surface of the toner hopper 41 such that it is partly located in the toner hopper 41. The developing roller 44 lightly contacts both the photosensitive drum 1 and the feed roller 43. The feed roller 43 and the developing roller 44 are rotated in the counterclockwise direction by a rotary drive mechanism (not shown). The feed roller 43 carries the toner stored in the toner hopper 41 and supplies it to the developing roller 44. The developing roller 44 carries the toner provided by the feed roller 43 and causes it to contact the surface of the photosensitive drum 1.

The feed roller power source **45*a* supplies a predetermined feed roller bias, e.g., 400 V to the feed roller 43**.

The developing roller power source **45*b* supplies a predetermined developing roller bias, e.g., 300 V to the developing roller 44**.

The cylindrical support rod 47 is arranged parallel to and above the developing roller 44 to support the developing blade 46 in contact with the developing roller 44. The spring 48, which is fixed to the support 49, urges the support rod 47 toward the developing roller 44 with a predetermined force. Thus, the developing blade 46 is urged against the developing roller 44. The support 49 is fixed to the side wall of the toner hopper 41.

The transfer device 5 includes a transfer roller 51 rotating in a counterclockwise direction in contact with the photosensitive drum. The transfer device 5 further includes a transfer power source 52 which supplies a predetermined negative transfer voltage to the transfer roller 51.

The paper powder removal unit 6 includes a paper powder removal brush 61 and a paper powder removal power source 63 which supplies a predetermined positive voltage to the paper powder removal brush 61. The brush is made of a rayon material which preferably includes carbon. The brush 61 contacts the photosensitive drum. The paper powder attached to the photosensitive drum includes a material known as "talc". Talc is the main constituent of the paper powder and has the property of easily becoming negatively charged by friction. The paper powder including the negatively charged talc is drawn to the paper powder removal brush 61 to which the positive voltage is supplied.

The distributing device 7 includes a distributing brush 71 and a distributing power source 73. The distributing brush 71 is made of a rayon material which preferably includes carbon. The distributing brush 71 is approximately $1.7\times 10^6\Omega$. The distributing brush 71 contacts the photosensitive drum 1 at approximately 15°. The distributing power source 73 supplies −600 V to the brush 71.

In the facsimile apparatus having the structure as described above, an image is printed in the following manner as shown in FIGS. 2A–2J.

Figure 2A:
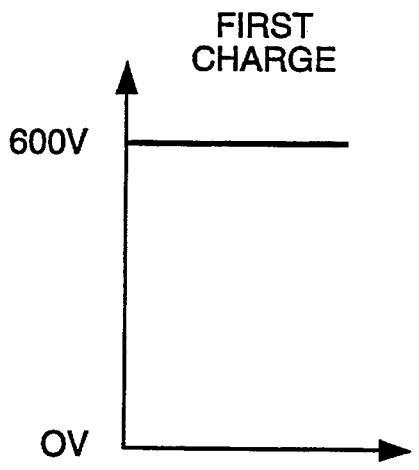
FIGS. 2A through 2J are sequential diagrams illustrating an image forming process performed by the apparatus shown in FIG. 1.
Figure 2B:
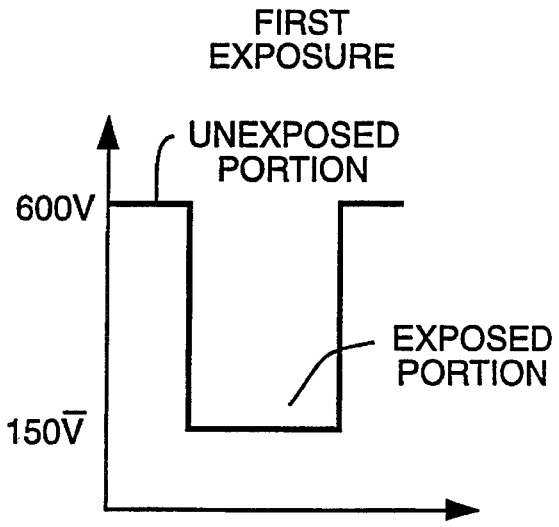

Referring to FIG. 2A first, the charging device 2 charges the surface (photosensitive surface) of the photosensitive drum 1 to a predetermined potential (e.g., +600 V). Subsequently, referring to FIG. 2B, the exposure device 3 exposes the charged photosensitive surface of the photosensitive drum 1 in accordance with an image to be printed, thereby forming an electrostatic latent image. The potential of the exposed portion corresponding to the electrostatic latent image is 150 V.

Referring again to FIG. 1, in the developing device 4, the feed roller 43 carries the toner to the developing roller 44. The developing roller 44 carries and conveys the toner. When the developing roller 44 rotates, toner carried on the developing roller 44 receives friction between the developing roller 44 and developing blade 46. As a result, the toner is charged by friction. The surface of the developing roller 44 includes a layer which tends to be charged in negative polarity by friction with the toner. Accordingly, the toner is charged in the positive polarity due to the polarization effect caused by this layer.

Figure 2C:
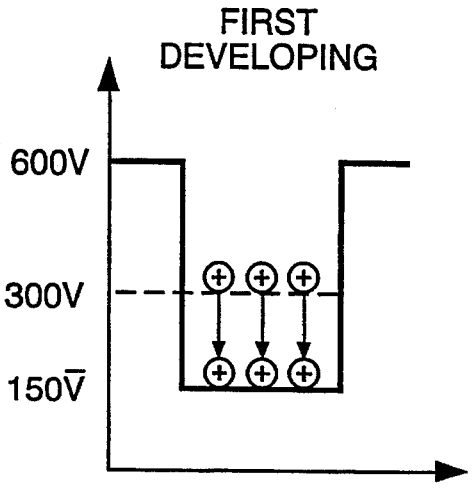
Figure 2D:
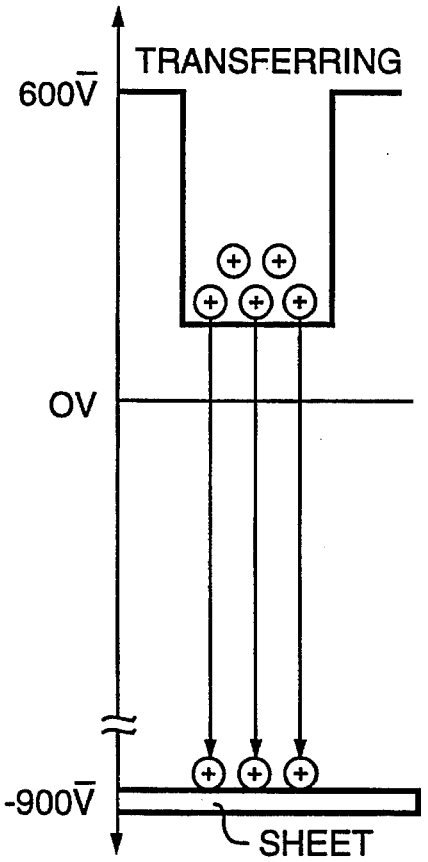

Referring to FIG. 2C, a developing bias, for example +300 V, having the same polarity as that of the potential charged on the photosensitive drum 1, is applied to the developing roller 44 by the developing power source 45. The toner selectively attaches to the exposed portion of the photosensitive drum 1 due to the presence of the electric field among the electrostatic latent image, the developing bias, and the charge of toner. More specifically, the toner does not attach to the non-exposed portion of the photosensitive drum 1 since the potential at this portion is more positive than that of the developing roller transporting toner, and the toner attaches to the exposed portion of the photosensitive drum 1 since the potential at this portion of the photosensitive drum 1 is less positive than that of the developing roller transporting toner. In this manner, a toner image corresponding to the electrostatic latent image is formed on the surface of the photosensitive drum 1. Referring to FIG. 2D, this toner image is transferred to a printing sheet P by a negative voltage (−900 V) of the transfer device 5.

Figure 2E:
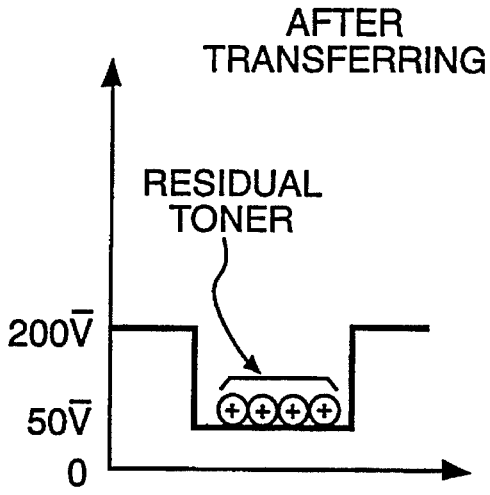
Figure 2F:
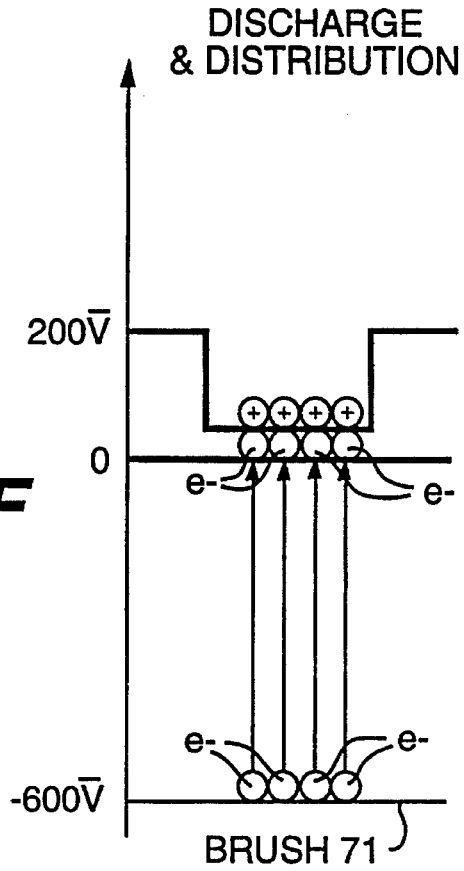

Referring to FIG. 2E, after the printing sheet P is separated from the photosensitive drum 1, the toner which is not transferred remains on the surface of the photosensitive drum 1 as residual toner.

Figure 2G:
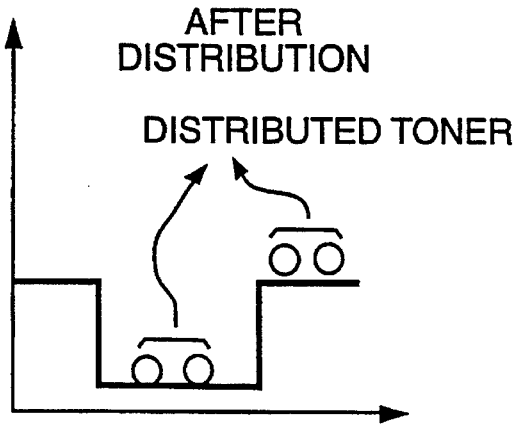
Figure 3:
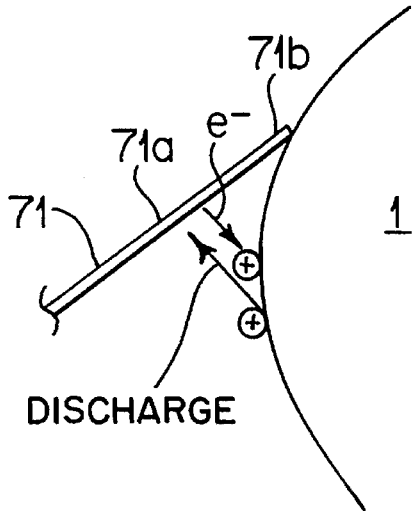
FIG. 3 is a partial cross-section view illustrating a distribution device according to the first embodiment shown in FIG. 1.

Thereafter, the portion of the photosensitive drum 1 transporting the residual toner reaches the position near the distributing brush 71 as shown in FIG. 3. After the transfer device 5 transfers the toner image to the printing sheet P, the potential of the exposed portion falls to 50 V and the potential of the unexposed portion falls to 200 V. The supplied voltage of the distributing brush 71 is −600 V. Therefore the potential difference between the exposed portion transporting the residual toner and a non-contact portion 71*a* of the distribution brush 71 is 650 V. If the potential difference between the exposed portion in the organic photoconductor layer of the photosensitive drum 1, including perylene pigment, pathalocyanine pigment, hydrozone pigment and polycarbonate, and the distributing brush 71 including the rayon material which includes the carbon, is more than 600 V, a discharge occurs between them. When the discharge from the photosensitive drum 1 to the distributing brush 71 occurs, a negative charge is injected to the residual toner according to the discharge. As a result, the charge of the residual toner becomes approximately 0 V. In this state, the residual toner is not bound to the photosensitive drum 1. Thereafter, the exposed portion of the photosensitive drum 1 arrives at the contact portion 71*b* of the distributing brush 71. Since the residual toner is insufficiently bound to the exposed portion, it is distributed on the surface of the photosensitive drum 1 by the contact portion 71*b* of the distributing brush 71. FIG. 2G shows the state after the distribution. As a result, the residual toner on the exposed portion is distributed. Therefore some of the residual toner particles in the exposed portion are moved toward the non-exposed portion.

Figure 2H:
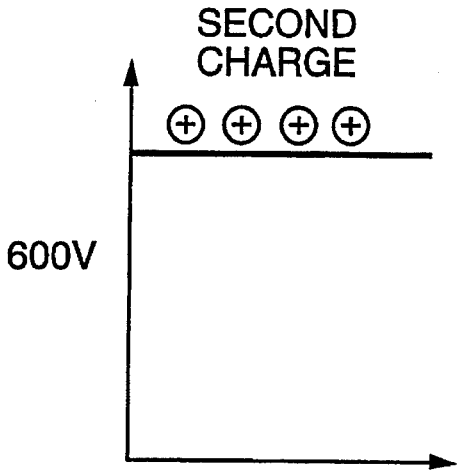

After that, the surface portion of the photosensitive drum 1 having the residual toner distributed thereon moves to a position adjacent the charging device 2 as a result of the continuous rotation of the photosensitive drum 1. The charging device 2 charges this portion of the photosensitive drum 1 at 600 V and positively charges the distributed residual toner. FIG. 2H shows the resulting state.

Figure 2I:
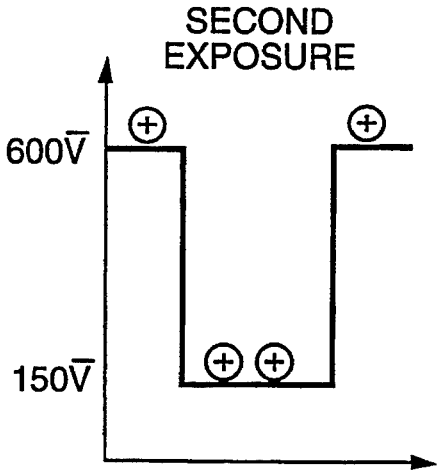

Thereafter, the exposure device 3 exposes the charged portion of the photosensitive drum 1. FIG. 2I shows the resulting state. In this state, the residual toner is distributed on the photosensitive drum 1, and the light from the exposure device 3 impinges on the charged portion of the photosensitive drum 1 on which the residual toner exists. The potential of an exposed portion thus becomes 150 V, and a new latent image is formed on the photosensitive drum 1.

Figure 2J:
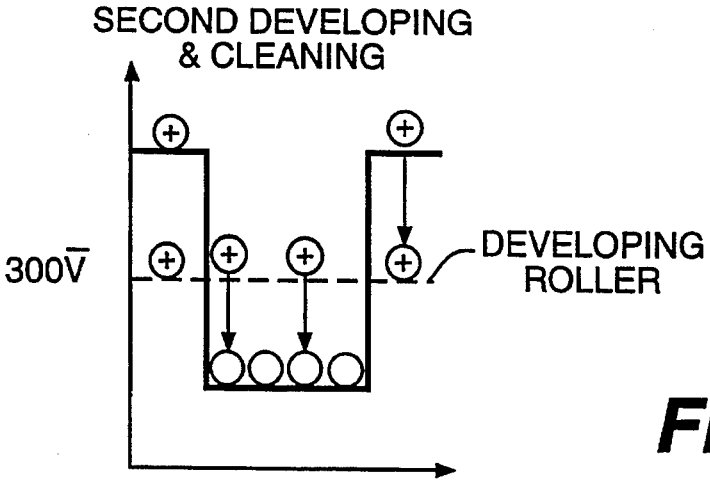

After that, the surface portion of the photosensitive drum 1 having the new latent image thereon moves to a position adjacent the developing roller 44 as a result of the continuous rotation of the photosensitive drum 1. FIG. 2J shows this state in which the new latent image is developed. The potential of the developing roller 44 is 300 V, and the potential of the non-exposed portion of the photosensitive drum 1 is 600 V. Therefore, the potential of the non-exposed portion of the photosensitive drum 1 is more positive than that of the developing roller 44. As a result, the residual toner remaining on the non-exposed portion is drawn to the developing roller 44. Further, the potential of the developing roller 44 is more positive than that of the exposed portion of the photosensitive drum 1. Therefore the toner on the developing roller 44 is attracted to the exposed portion.

As described above, the image forming apparatus of the first embodiment requires only one distributing device 7 for distributing the residual toner on the photosensitive drum 1. Therefore, compared to the conventional image forming apparatus, which requires two components for distributing the residual toner, the image forming apparatus of the first embodiment is lighter and less bulky.

In the above embodiment, the paper powder removal device 6 is provided for removing the paper powder adhered to the photosensitive drum 1. The paper powder is generated and removed in the following manner. During the transferring procedure, paper powder from the printing paper adheres to the photosensitive drum 1. When the second developing step is performed as shown in FIG. 2J, the paper powder adhered to the drum 1 moves to the developing roller 44 since the photosensitive drum 1 lightly contacts the developing roller 44.

After that, the paper powder is transferred on the developing roller 44 together with the toner, and receives a charge caused by friction between the developing roller 44 and the developing blade 46. As stated above, the paper powder includes talc. This talc has a tendency to be negatively charged when it receives a frictional charge. Thus, the paper powder is also negatively charged as a result of the friction between the developing roller 44 and the developing blade 46.

Thereafter, the paper powder is transferred to the position near the photosensitive drum 1. In this state, since the photosensitive drum 1 is positively charged, the drum 1 attracts the paper powder having negatively charged talc. Thereafter, the negatively charged paper powder arrives at the transfer device 5, it is not transferred to the paper because the transfer voltage is negative.

After that, the paper powder on the photosensitive drum arrives at the paper powder removal brush 61. In this state, the power source 63 supplies a positive voltage with the brush 61. Therefore, the paper powder being negatively charged, is drawn to the brush 61. Since the paper powder is collected by the brush 61, storage of the paper powder on the surface of the photosensitive drum 1 and in the developing device 4 may be avoided.

By removing the paper powder from the drum 1, the paper powder will not accumulate in the developing roller 44, and therefore, the paper powder will not prevent the toner from receiving a sufficient frictional charge. Further, the paper powder on the contact portion of the photosensitive drum 1 contacting the developing roller 44 will not prevent the toner from being sufficiently attracted to the photosensitive drum 1. The embodiment with the paper powder removal device 6 is particularly effective when applied in the development system described above, which utilizes non-magnetic, single component toner and the contacting developing roller contacting with the photosensitive drum.

Figure 4:
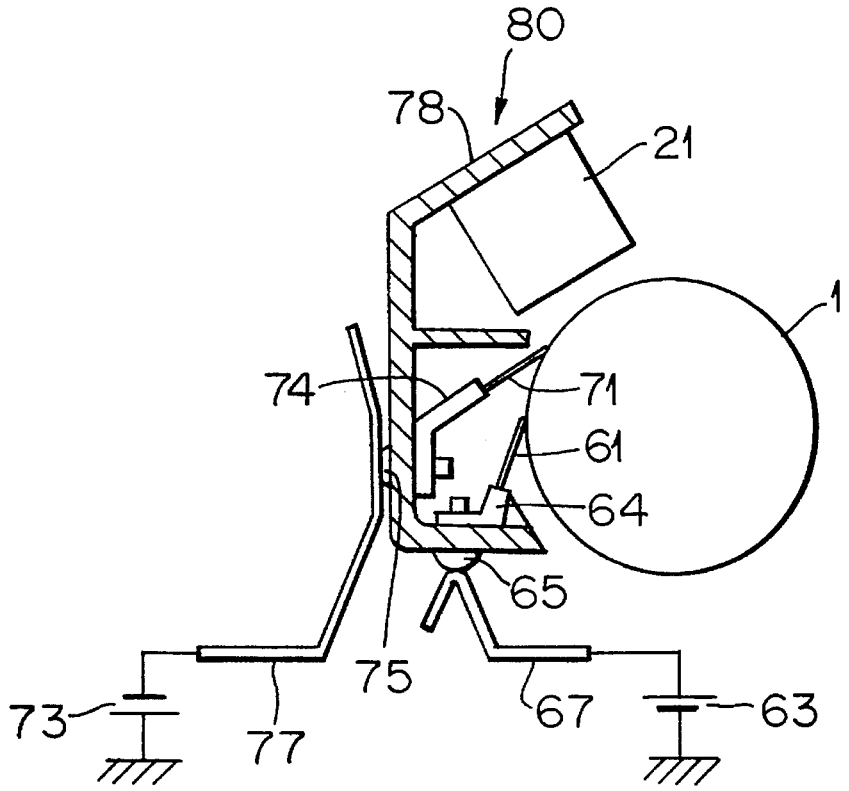
FIG. 4 is a partial cross-section view illustrating power supply terminals provided in the apparatus shown in FIG. 1.

FIG. 4 shows a structure including power source terminals provided in the image forming apparatus for connecting the brushes 61, 71 with the power sources 63, 73. Referring to FIG. 4, the brush 61 is fixed on the side cover 78 of the process unit 80 by a conductive material 64 and a conductive screw 65. The brush 71 is fixed on the side cover 78 by a conductive material 74 and a conductive screw 75. The screw 65 is electrically connected to the brush 61 via the conductive material 64. The screw 75 is electrically connected to the brush 71 via the conductive material 74.

Terminals 67, 77 are provided in the image forming apparatus, and are connected to the power sources 63 and 73, respectively. When the process unit 80 is installed in the image forming apparatus, the screws 65, 75 respectively contact the terminals 67, 77. In this way, each brush is electrically connected to each power source in accordance with the installation of the process unit. Therefore, the process unit 80 does not require two power sources of its own for supplying voltage to each brush. This results in the miniaturization and the lightening of the process unit 80.

Figure 5:
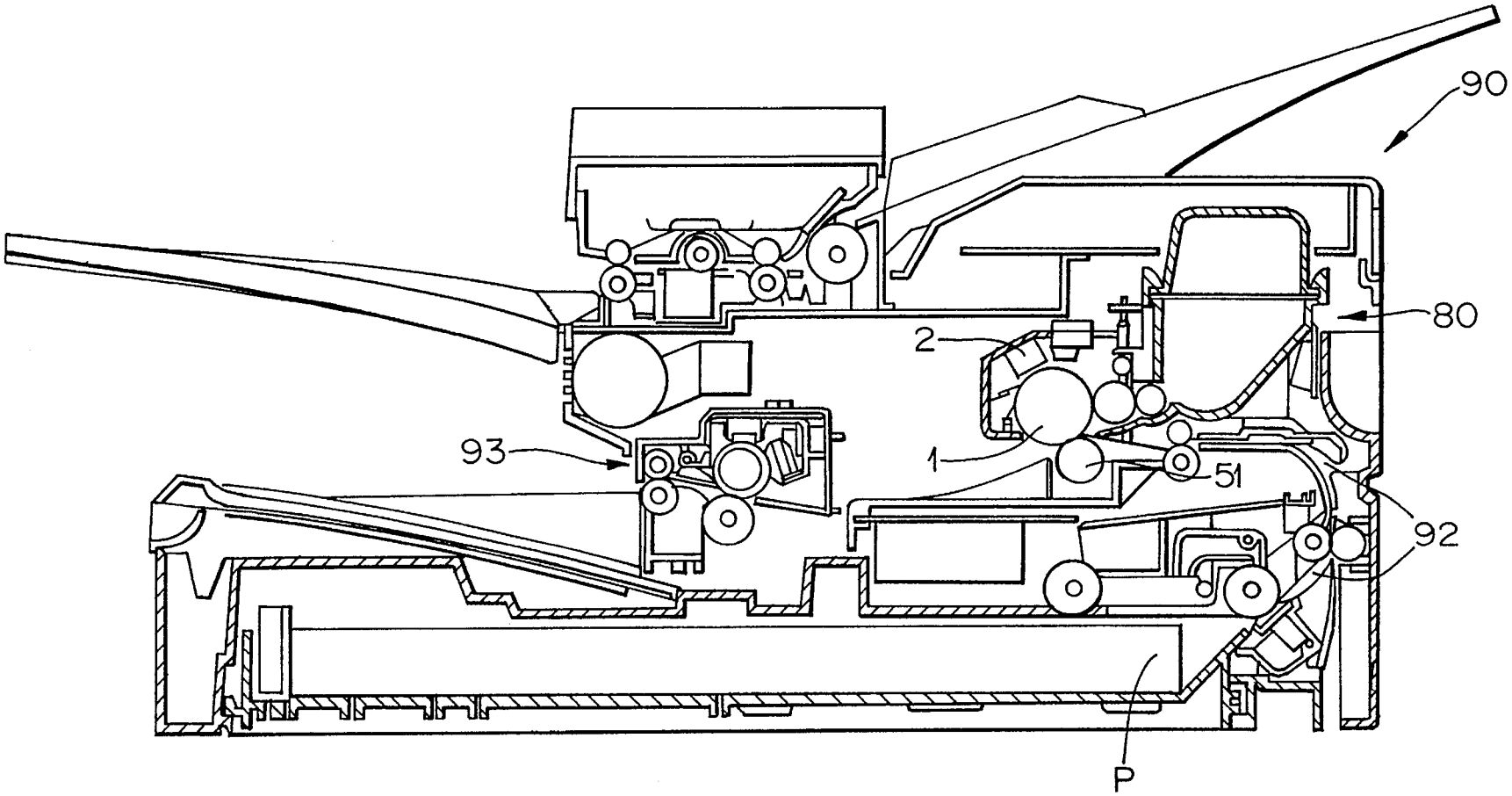
FIG. 5 is a schematic view of a facsimile apparatus incorporating the image forming apparatus according to the first embodiment.

FIG. 5 shows the image forming apparatus 90 such as a facsimile apparatus including the process unit 80. The process unit 80 is mountable into the housing of the image forming apparatus 90. The paper P is transferred through a path 92 to the transfer roller 51. After the toner image is transferred on the paper P at the transfer device 51, the paper P is transferred to a fixing device 93 for fixing the toner image on the paper P by the pressure of rollers. After that the paper P comes out from the image forming apparatus 90.

Figure 6:
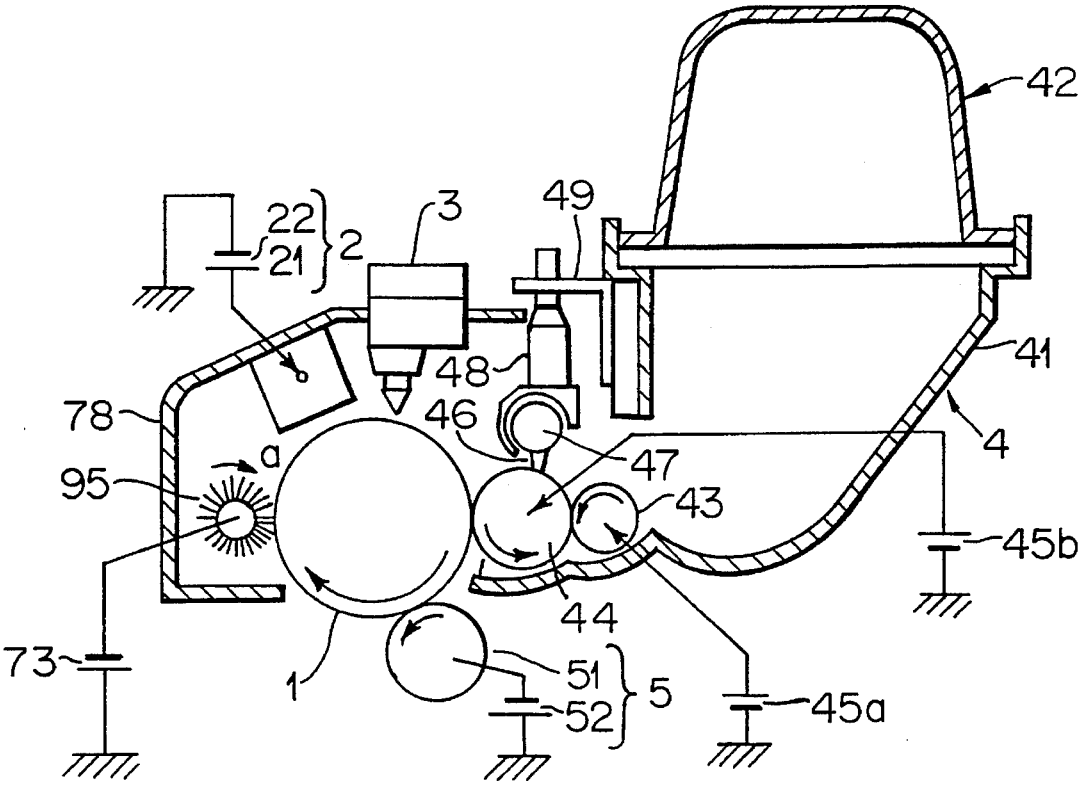
FIG. 6 is a schematic view illustrating a second embodiment of the present invention.

FIG. 6 shows a second embodiment. The second embodiment differs from the first embodiment with respect to the distributing device. This distributing device includes a rotating brush 95, which is supported by the side cover 78 and is rotated in direction a by a rotary mechanism (not shown). The rotating brush 95 is made of a rayon material which preferably includes carbon. The brush preferably has resistance approximately $1.7\times10^{6}\Omega$. The direct current power source 73 supplies −600 V to the rotating brush 95.

Figure 7:
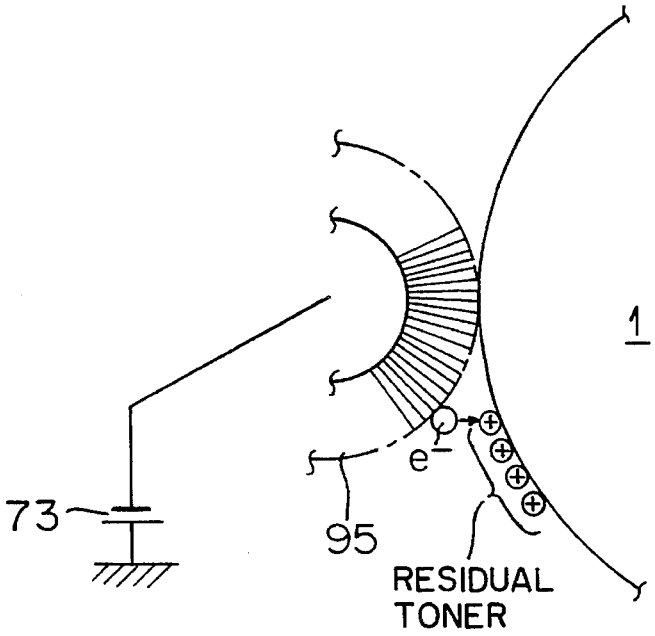
FIG. 7 is a partial cross-section view illustrating a distribution device according to the second embodiment shown in FIG. 6.

FIG. 7 illustrates the relationship between the residual toner and the rotating brush 95. Before the residual toner contacts the rotating brush 95, a discharge occurs between the photosensitive drum 1 and the rotating brush 95. As a result, negative charge is injected to the residual toner in the same manner as the first embodiment. Then, the residual toner is not bound to the photosensitive drum 1. In this state, when the residual toner contacts the rotating brush 95 in accordance with the rotation of the photosensitive drum 1 and the rotating brush 95, the residual toner is distributed by the rotating brush 95.

Further, it is confirmed by an experience that some of the paper powder on the photosensitive drum is collected into the rotating brush 95 by the mechanical scratching force of the rotating brush 95.

Figure 8:
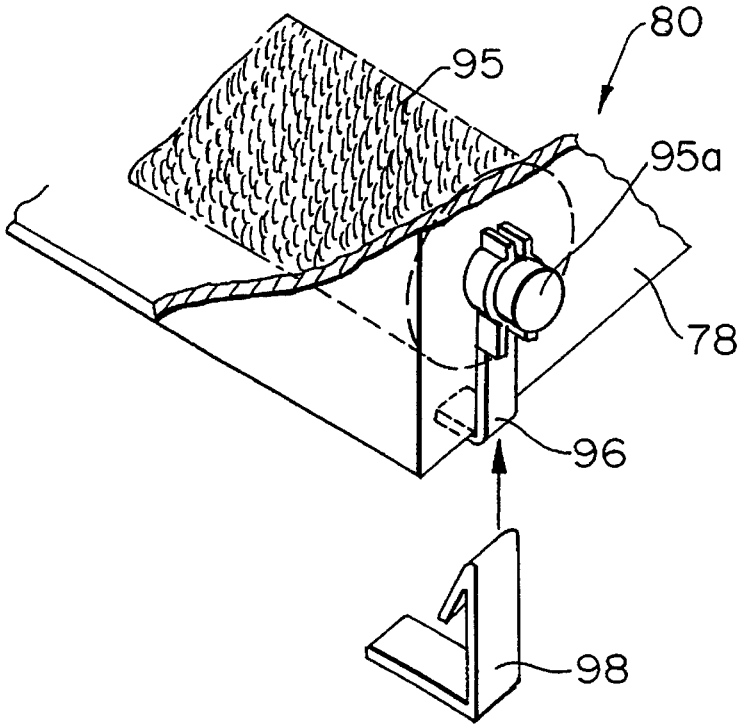
FIG. 8 is a partial perspective view illustrating power supply terminals provided in the apparatus shown in FIG. 6.
Figure 9:
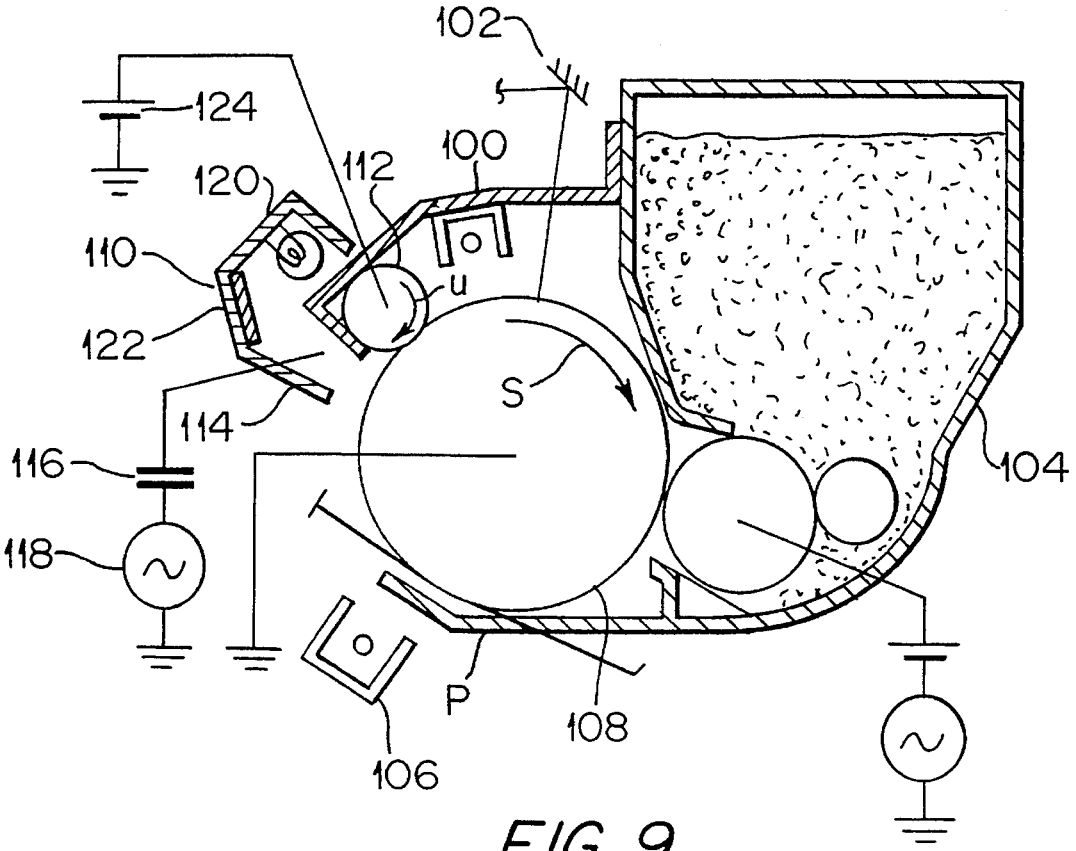
FIG. 9 is a schematic view illustrating a conventional image forming apparatus.

FIG. 8 shows the relationship between the process unit 80 having the rotating brush 95 and a terminal connected to the power source 73. Referring to FIG. 8, the shaft 95*a* of the rotating brush 95 is supported by the side cover 78 of the process unit 80. The shaft 95*a* is engaged with a conductive fitting 96. The conductive fitting 96 has an engagement portion for being engaged with the shaft 95*a* of the rotating brush 95 and a contacting portion attached to the side cover 78 for contacting a terminal 98 provided in the image forming apparatus. The terminal 98 is electrically connected to the power source 73. When the process unit 80 is installed into the image forming apparatus, the conductive fitting 96 contacts the terminal 98. As a result, through the terminal 98 and the conductive fitting 96, the power source 73 supplies −600 V to the rotating brush 95.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

We claim:

1. An image forming apparatus comprising:

a photosensitive member;

charging means for charging the photosensitive member;

exposing means for exposing the charged photosensitive member to form a latent image on the photosensitive member;

developing means for developing the latent image with toner to form a developed toner image on the photosensitive member;

transferring means for transferring the developed toner image to a sheet-like material;

a paper powder removal brush, located between the transferring means and the charging means, and supplied with a positive voltage, for removing paper powder adhered on the photosensitive member;

distributing means for distributing residual toner remaining on the photosensitive member after the transfer of the developed toner image and before a subsequent image is to be formed, the distributing means including:

a distributing brush located between the transferring means and the charging means, having a contact portion contacting the photosensitive member, and voltage supply means for supplying a direct current voltage to the distributing brush, the voltage difference between the distributing brush and the photosensitive member being sufficient to cause a discharge to occur between the distributing brush and the photosensitive member; and removing means for removing the distributed residual toner on the photosensitive member by transferring the distributed residual toner from the photosensitive member to the developing means, the removing means being operated simultaneously with the developing means.

2. The image forming apparatus of claim 1 wherein the image forming apparatus is enclosed in a housing, and the distributing brush has a base and a tip, the base being fixed to the housing and the tip contacting the photosensitive member.

3. The image forming apparatus of claim 1 wherein the image forming apparatus is enclosed in a housing, and the distributing brush is a rotating brush having a shaft supported by the housing, and the distributing brush is rotated in contact with the photosensitive member.

4. The image forming apparatus of claim 1 wherein the developing means includes a developing roller rotating in contact with the photosensitive member.

5. The image forming apparatus of claim 1 wherein the developing means further includes a developing roller and a developing blade wherein the toner is charged by friction between the developing roller and the developing blade.

6. The image forming apparatus of claim 1 wherein the photosensitive member is positively charged.

7. A process unit mountable into an image forming apparatus, the image forming apparatus including a transfer device, a first terminal and voltage supply connected to the first terminal, the process unit comprising:

a photosensitive member;

charging means for charging the photosensitive member;

exposing means for exposing the charged photosensitive member to form a latent image on the photosensitive member;

developing means for developing the latent image with toner to form a developed toner image on the photosensitive member;

a transfer portion for allowing the developed toner image to be transferred from the photosensitive member to a sheet-like material by the transfer device;

a distributing brush, located between the transfer portion and the charging means, having a contact portion contacting the photosensitive member, a second terminal electrically connected to the distributing brush; and removing means for the distributed residual toner remaining on the photosensitive member by transferring the distributed residual toner from the photosensitive member to the developing means, the removing means being operated simultaneously with the developing means, wherein, when the process unit is mounted into the image forming apparatus, the first terminal contacts the second terminal, and the voltage difference between the distributing brush and the photosensitive member is sufficient to cause a discharge to occur between the distributing brush and photosensitive member.

8. The process unit of claim 7 wherein the process unit is enclosed in a housing and the second terminal is provided outside of the housing.

9. The process unit of claim 8 wherein the distributing brush has a base and a tip, the base being fixed to the housing by the second terminal, the tip contacting the photosensitive member.

10. The process unit of claim 7 wherein the distributing brush is a rotating brush having a shaft supported by the housing, and the distributing brush in rotated in contact with the photosensitive member.

11. The process unit of claim 7 further comprising a paper powder removal brush, located between the transfer portion and the charging means, and supplied with positive voltage, for removing paper powder adhered on the photosensitive member.

12. The process unit of claim 11 wherein the image forming apparatus further includes a third terminal and paper powder removal power supply means connected to the third terminal, and the process unit further includes a fourth terminal connected to the paper powder removal brush, and when the process unit is mounted into the image forming apparatus, the third terminal contacts the fourth terminal.

13. The image forming apparatus of claim 7 wherein the developing means includes a developing roller rotating in contact with the photosensitive member.

14. The process unit of claim 7 wherein the developing means further includes a developing roller and a developing blade, wherein the toner is charged by friction between the developing roller and the developing blade.

15. The process unit of claim 7 wherein the photosensitive member is positively charged.

16. An image forming apparatus comprising:

transfer means;

a first terminal;

voltage supply means electrically connected to the first terminal; and a process unit including:

a photosensitive member, charging means for charging the photosensitive member, exposing means for exposing the charged photosensitive member to form a latent image on the photosensitive member, developing means for developing the latent image with toner to form a toner developed image on the photosensitive member toner;

a transfer portion facing with the transfer means, a distributing brush, located between the transfer portion and the charging means, having a contact portion contacting the photosensitive member, a second terminal electrically connected to the distributing brush; and removing means for removing the distributed residual toner remaining on the photosensitive member by transferring the distributed residual toner from the photosensitive member to the developing means, the removing means being operated simultaneously with the developing means, wherein, when the process unit is mounted into the image forming apparatus, the first terminal contacts the second terminal, and the voltage difference between the distributing brush and the photosensitive member is sufficient to cause a discharge to occur between the distributing brush and photosensitive member.

* * * * *